US008507817B2

(12) United States Patent
Gottschalk et al.

(10) Patent No.: US 8,507,817 B2
(45) Date of Patent: Aug. 13, 2013

(54) LATCH ASSEMBLY AND ELECTRICAL SWITCHING APPARATUS INCLUDING THE SAME

(75) Inventors: Andrew L. Gottschalk, Monaca, PA (US); Roger W. Helms, Beaver Falls, PA (US); David A. Parks, Baden, PA (US); Robert M. Slepian, Murrysville, PA (US)

(73) Assignee: Eaton Corporation, Cleveland, OH (US)

( * ) Notice: Subject to any disclaimer, the term of this patent is extended or adjusted under 35 U.S.C. 154(b) by 367 days.

(21) Appl. No.: 13/028,291

(22) Filed: Feb. 16, 2011

(65) Prior Publication Data

US 2012/0205226 A1 Aug. 16, 2012

(51) Int. Cl.
*H01H 23/00* (2006.01)

(52) U.S. Cl.
USPC ..... 200/401

(58) Field of Classification Search
USPC ..... 200/401, 400, 337, 17 R, 500, 501, 200/424; 403/197; 29/517, 520, 523, 526.2; 74/519
See application file for complete search history.

(56) References Cited

U.S. PATENT DOCUMENTS

| | | | | |
|---|---|---|---|---|
| 3,012,800 | A | 12/1961 | Koch | |
| 4,125,008 | A | 11/1978 | Genest et al. | |
| 6,015,959 | A * | 1/2000 | Slepian et al. | 200/400 |
| 7,294,804 | B1 | 11/2007 | Gottschalk et al. | |
| 7,633,031 | B2 * | 12/2009 | Wehrli et al. | 200/401 |
| 2008/0237015 | A1 | 10/2008 | Rakus et al. | |
| 2008/0271982 | A1 * | 11/2008 | Gibson et al. | 200/401 |
| 2008/0302645 | A1 | 12/2008 | Rakus et al. | |
| 2011/0214975 | A1 * | 9/2011 | Gottschalk et al. | 200/400 |

FOREIGN PATENT DOCUMENTS

| | | | |
|---|---|---|---|
| DE | 101 44 588 | C1 | 1/2003 |
| EP | 0 340 128 | A1 | 11/1989 |
| EP | 1 057 552 | A1 | 12/2000 |
| GB | 2 034 439 | A | 6/1980 |

OTHER PUBLICATIONS

European Patent Office, "extended European search report", Jun. 28, 2012, 6 pp.

* cited by examiner

*Primary Examiner* — Edwin A. Leon
(74) *Attorney, Agent, or Firm* — Eckert Seamans Cherin & Mellott, LLC; Kirk D. Houser

(57) ABSTRACT

A latch assembly includes a latch plate having an opening therethrough; and a latch shaft having a shaft member and a positioning shoulder disposed on the shaft member. The positioning shoulder has a seating surface thereon. The shaft member passes through the opening of the latch plate. The latch plate engages the positioning shoulder of the shaft member. The seating surface of the shaft member is swaged to retain the latch plate to the shaft member.

24 Claims, 4 Drawing Sheets

LATCH ASSEMBLY AND ELECTRICAL SWITCHING APPARATUS INCLUDING THE SAME

BACKGROUND

1. Field

The disclosed concept pertains generally to electrical switching apparatus and, more particularly, to circuit breakers. The disclosed concept also pertains to latch assemblies for such circuit breakers.

2. Background Information

Latches are an important part of electrical switching apparatus, such as circuit breakers, and can take the form shown in FIG. 1. A latch assembly 2 includes three components: a D-shaft 4, a latch plate 6 and a latch shaft 8. The latch plate 6 and the latch shaft 8 are joined together (i.e., by copper brazing; by soldering; by welding followed by heat treating) and the latch plate 6 rotates about the longitudinal axis 9 of the latch shaft 8. The D-shaft 4 blocks (near D-shaft slot 10 when in a corresponding range of suitable axial positions), as shown, or allows the movement of the latch plate 6 (through the D-shaft slot 10 when in a corresponding suitable axial position (not shown)) as the D-shaft 4 rotates (e.g., clockwise with respect to FIG. 1) on its longitudinal axis 9. The latch shaft 8 and the D-shaft 4 both rotate about their respective longitudinal axes, which are disposed a fixed distance apart. The latch assembly 2 can only rotate clockwise (with respect to FIG. 1) when the D-shaft 4 is suitably oriented (not shown) to allow the latch plate 6 to pass through the D-shaft slot 10.

In order to optimize performance, the strength and the hardness of the latch plate 6 and the latch shaft 8 are carefully controlled, preferably inexpensively. For example, the latch plate 6 is made of 420 stainless steel and the latch shaft 8 is made of 410 stainless steel. These are copper brazed together and heat treated at the same time. However, the stainless steel will not get hard enough to hold up to life testing and, thus, the tip 12 of the latch plate 6 can deform. Also, a problem with copper brazing certain types of steel, such as 1070 stainless steel, is that the copper braze would melt when such steel is heat treated and, hence, the parts would not stay together in a heat treatment furnace.

Known current practices of rigidly joining the latch plate 6 to the latch shaft 8 include brazing or welding operations. However, for example, cracks in the welds after heat treatment can be an issue with welded parts. These operations present severe limitations on the choice of materials for these components and corresponding heat treatment options. The processes available with acceptable materials limit the component hardness and/or are difficult to control in a repeatable manner in an industrial environment. Hence, there is room for improvement in latch assemblies.

There is also room for improvement in electrical switching apparatus, such as circuit breakers, including a latch assembly.

SUMMARY

These needs and others are met by embodiments of the disclosed concept, which provide a latch assembly in which a latch plate and a shaft member of a latch shaft are swaged to retain the latch plate to the shaft member.

In accordance with one aspect of the disclosed concept, a latch assembly comprises: a latch plate having an opening therethrough; and a latch shaft comprising a shaft member and a positioning shoulder disposed on the shaft member, the positioning shoulder having a seating surface thereon, wherein the shaft member passes through the opening of the latch plate, wherein the latch plate engages the positioning shoulder of the shaft member, and wherein the seating surface of the shaft member is swaged to retain the latch plate to the shaft member.

As another aspect of the disclosed concept, an electrical switching apparatus comprises: separable contacts; an operating mechanism structured to open and close the separable contacts; and a latch comprising: a D-shaft, a latch plate having an opening therethrough, the latch plate having a portion structured to engage the D-shaft, and a latch shaft comprising a shaft member and a positioning shoulder disposed on the shaft member, the positioning shoulder having a seating surface thereon, wherein the shaft member passes through the opening of the latch plate, wherein the latch plate engages the positioning shoulder of the shaft member, and wherein the seating surface of the shaft member is swaged to retain the latch plate to the shaft member.

As another aspect of the disclosed concept, a latch comprises: a D-shaft; a latch plate having an opening therethrough, the latch plate having a portion structured to engage the D-shaft; and a latch shaft comprising a shaft member and a positioning shoulder disposed on the shaft member, the positioning shoulder having a seating surface thereon, wherein the shaft member passes through the opening of the latch plate, wherein the latch plate engages the positioning shoulder of the shaft member, and wherein the seating surface of the shaft member is swaged to retain the latch plate to the shaft member.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "swaging" shall mean a process of forging in which the dimensions of an item are altered using a die or dies, a swaging tool or a pressing tool. Swaging is usually a cold working process; however, it is sometimes done as a hot working process. The term "is swaged" as applied to an item (e.g., "an item is swaged") shall mean that the structure of such item is altered by swaging.

The disclosed concept is described in association with a circuit breaker, although the disclosed concept is applicable to a wide range of electrical switching apparatus.

Figure 1:
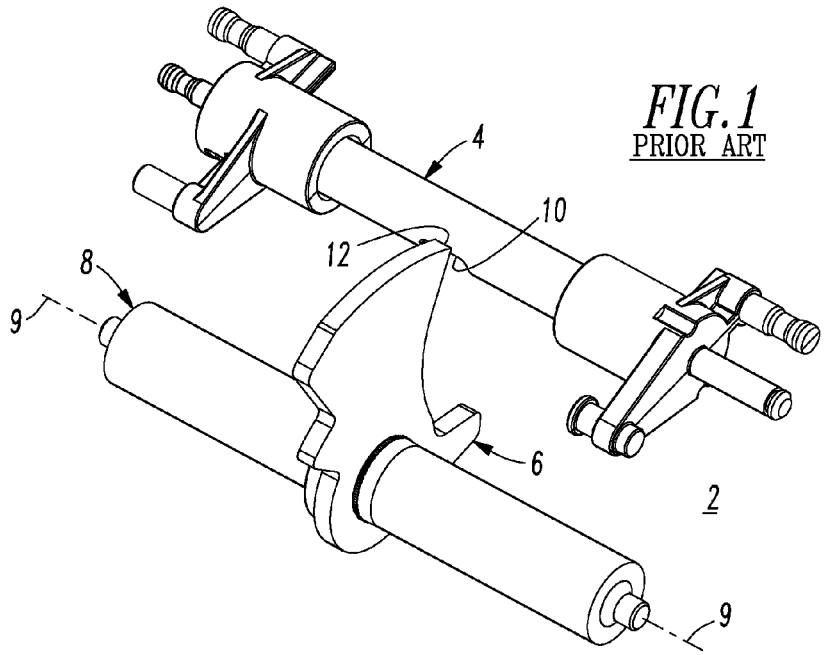
FIG. 1 PRIOR ART
FIG. 1 is an isometric view of a latch assembly including a D-shaft, a latch shaft and a latch plate.
Figure 2:
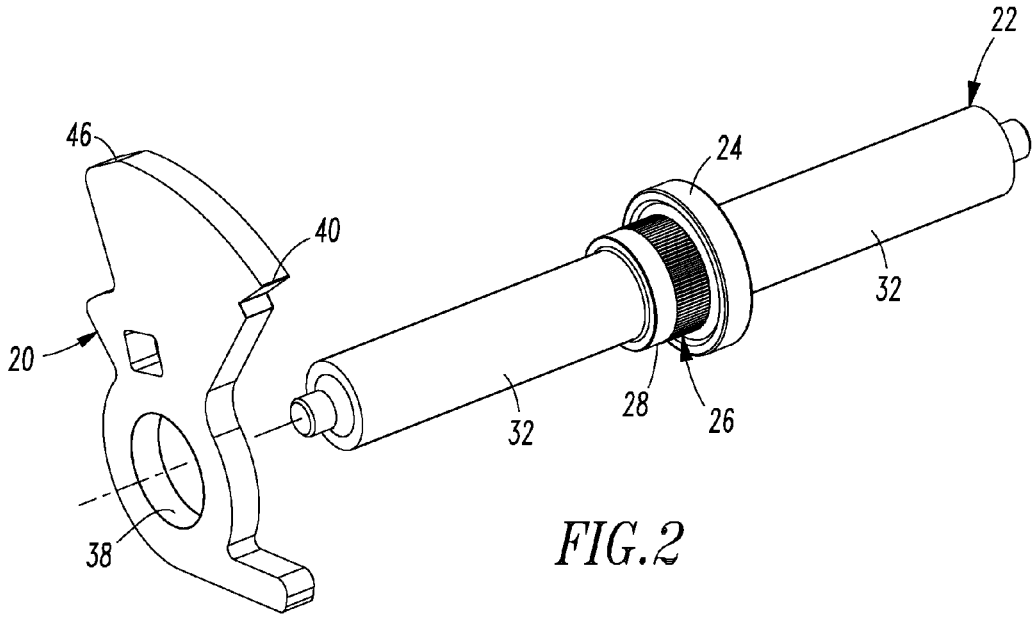
FIG. 2 is an unassembled isometric view of a latch shaft and a latch plate in accordance with embodiments of the disclosed concept.
Figure 6:
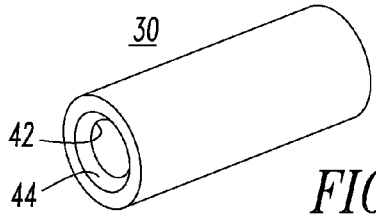
FIG. 6 is an isometric view of a swaging or pressing tool in accordance with embodiments of the disclosed concept.

FIG. 2 shows a latch plate 20 and a latch shaft 22 before assembly. The latch shaft 22 includes a positioning shoulder 24 and a seating surface 26 having an additional sacrificial section 28. The seating surface 26 of the latch shaft 22 abutting the positioning shoulder 24 is employed to locate the latch plate 20 on the latch shaft 22 as will be described in connection with FIGS. 3A and 3B. The additional sacrificial section 28 (FIGS. 2 and 3A) of the seating surface 26 is then suitably mechanically deformed (i.e., swaged) using a suitable cylindrical swaging or pressing tool 30 (FIG. 6), in order to retain the latch plate 20 to the shaft member 32 and lock the latch plate 20 in place. The mechanical deformation of the sacrificial section 28 provides the joining force. The fully assembled latch assembly 34 (FIG. 3B) then undergoes a suitable heat treatment using a suitably robust industrial process as will be described.

Figure 3A:
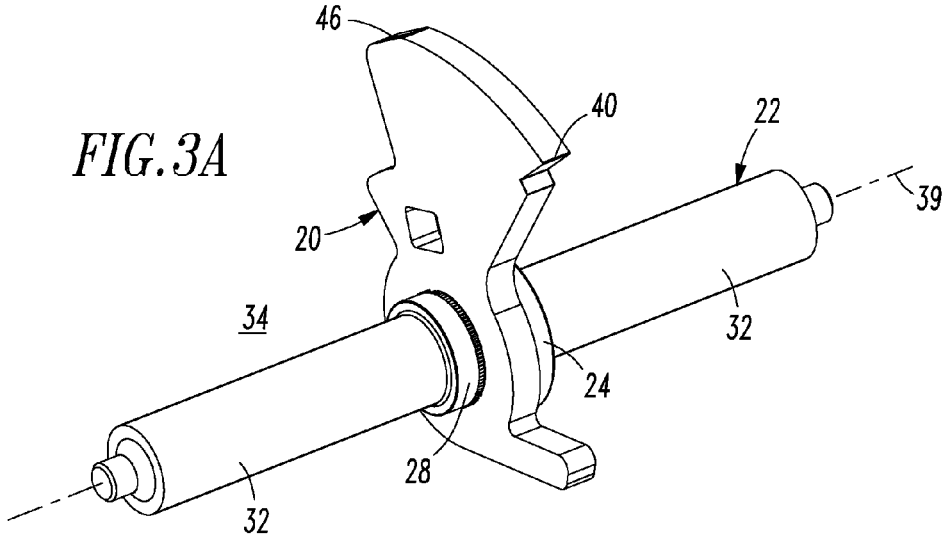
FIGS. 3A and 3B are assembled isometric views of the latch shaft and the latch plate of FIG. 2 before and after swaging, respectively.
Figure 3B:
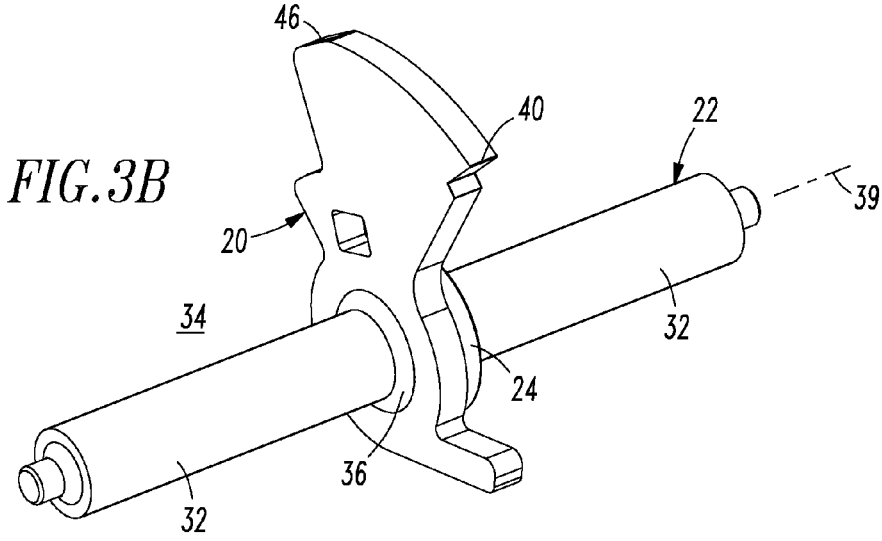

FIGS. 2, 3A and 3B show the mechanical joining of the latch plate 20 and the latch shaft 22. This allows a wide range of material selections and heat treatments. The resulting available materials and heat treatment processes are relatively less expensive, relatively more reliable, and allow a more suitable combination of material properties (e.g., strength and toughness) than are possible with known prior brazing or welding operations. FIG. 3A shows the latch assembly 34 having the sacrificial section 28 before swaging. FIG. 3B shows the latch assembly 34 having a raised surface 36 after swaging.

The latch assembly 34 includes the latch plate 20 having an opening 38 therethrough, and the latch shaft 22 having the shaft member 32 and the positioning shoulder 24 disposed on the shaft member 32. The positioning shoulder 24 has the seating surface 26 thereon. The shaft member 32 and a portion of the seating surface 26 pass through the latch plate opening 38. The latch plate 20 engages the shaft member positioning shoulder 24. The sacrificial section 28 of the shaft member seating surface 26 is swaged to retain the latch plate 20 to the shaft member 32.

Figure 4:
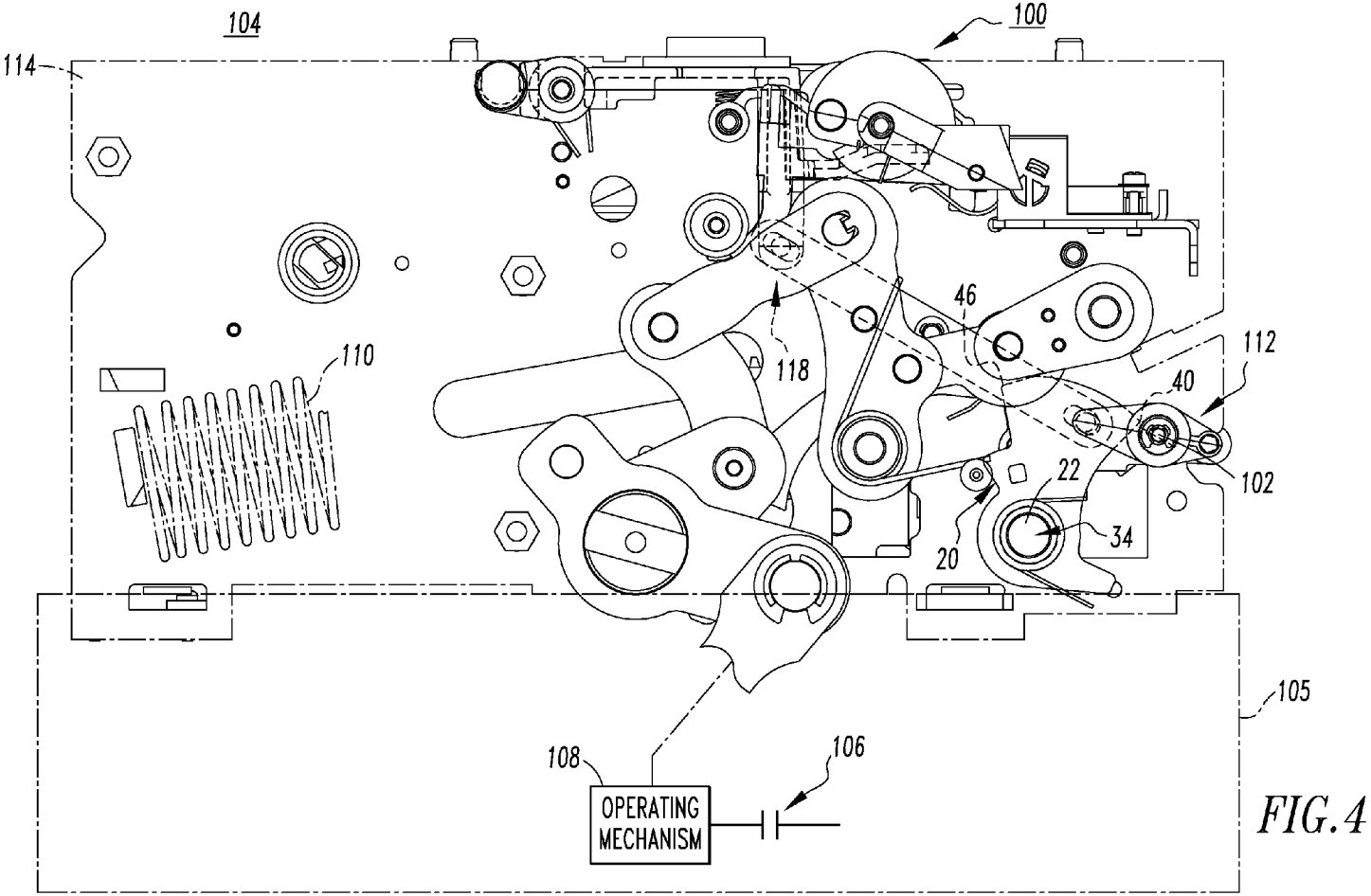
FIG. 4 is a side elevation view of a portion of a circuit breaker and a status indicating assembly therefor, including the latch assembly of FIG. 3B, with the circuit breaker housing and hidden components being shown in simplified form.

The disclosed latch plate 20 is perpendicular to the latch shaft 22. Also, it is desired that the latch edge 40 be hard enough to not deform under Hertzian contact stress (e.g., localized stresses that develop as two curved surfaces come in contact and deform slightly under the imposed loads) but not so brittle that it chips when the corresponding circuit breaker 104 (FIG. 4) latches. The roller surface 46 of the latch plate 20 is precisely placed to give a moment arm about the latch shaft 22 to get the correct load on the trip D-shaft 102 (FIGS. 4 and 5) in order that the circuit breaker 104 can be interrupted by a trip actuator (not shown), which has, for example and without limitation, only a maximum of about two pounds of force. The latch plate 20 is a planar member having the latch edge 40 engaging the trip D-shaft 102 as shown in FIG. 4.

The latch shaft 22, positioning shoulder 24 and seating surface 26 are a single piece. This can be formed, for example, on a lathe (not shown) in one operation to ensure that the single piece is concentric, has a central longitudinal axis 39, and that the positioning shoulder 24 is perpendicular to the latch shaft longitudinal axis 39.

The disclosed concept employs 1070 or 1095 spring steel for the latch plate 20, in order to get a suitably hard latch edge 40 to prevent deformation, and a 1045 steel latch shaft 22. The two parts are pressed together when the parts are soft and then the latch shaft 22 is swaged to retain the latch plate 20 thereon. When the latch shaft 22 is swaged, the sacrificial section 28 (FIGS. 2 and 3A) of the seating surface 26 of the latch shaft 22 is pushed into the latch plate 20 taking up any clearance and making a tight fit. The sacrificial section 28 portion of the seating surface 26 forms, for example and without limitation, a 0.020" bead of material around the opening 38 of the latch plate 20 at the raised surface 36 (FIG. 3B) to mechanically retain the latch plate 20 to the shaft member 32 and ensure that the latch plate 20 does not come off.

Next, the parts are heat treated and plated. All of the formed material of the latch shaft 22 then becomes hardened to Rockwell C (HRC) 35 to HRC 40 for a 1045 steel latch shaft, in order that it will not deform during life testing. The latch plate 20 will then become hardened in the range of HRC 50 to HRC 55 for a 1070 or 1095 spring steel for the latch plate, in order to prevent the latch edge 40 from deforming under Hertzian contact stress. The Rockwell scale is a hardness scale based on the indentation hardness of a material. The Rockwell test determines the hardness by measuring the depth of penetration of an indenter under a large load compared to the penetration made by a preload. There are different scales, which are denoted by a single letter, that use different loads or indenters. The result, which is a dimensionless number, is noted by HRX where X (e.g., C for relatively harder steels) is the scale letter.

An example heat treatment process for 1070 spring steel austenitizes (e.g., without limitation, heats the steel to a temperature at which it changes crystal structure from ferrite to austenite; the presence of carbides may occur or be present during a two-phase austenitization) in a match carbon atmosphere (e.g., 0.70%), quenches in water, and tempers the steel to obtain a hardness of HRC 50 to HRC 55. The process cycle can include heating to 1475° F., holding for 3 to 7 minutes at temperature, quenching in water, cleaning the parts to remove quench oil, and tempering at 500 to 700° F. for one hour.

An example plating process for the latch assembly 34 is ASTM B733-04 (2009) Standard Specification for Autocatalytic (Electroless) Nickel-Phosphorus Coatings on Metal.

Figure 5:
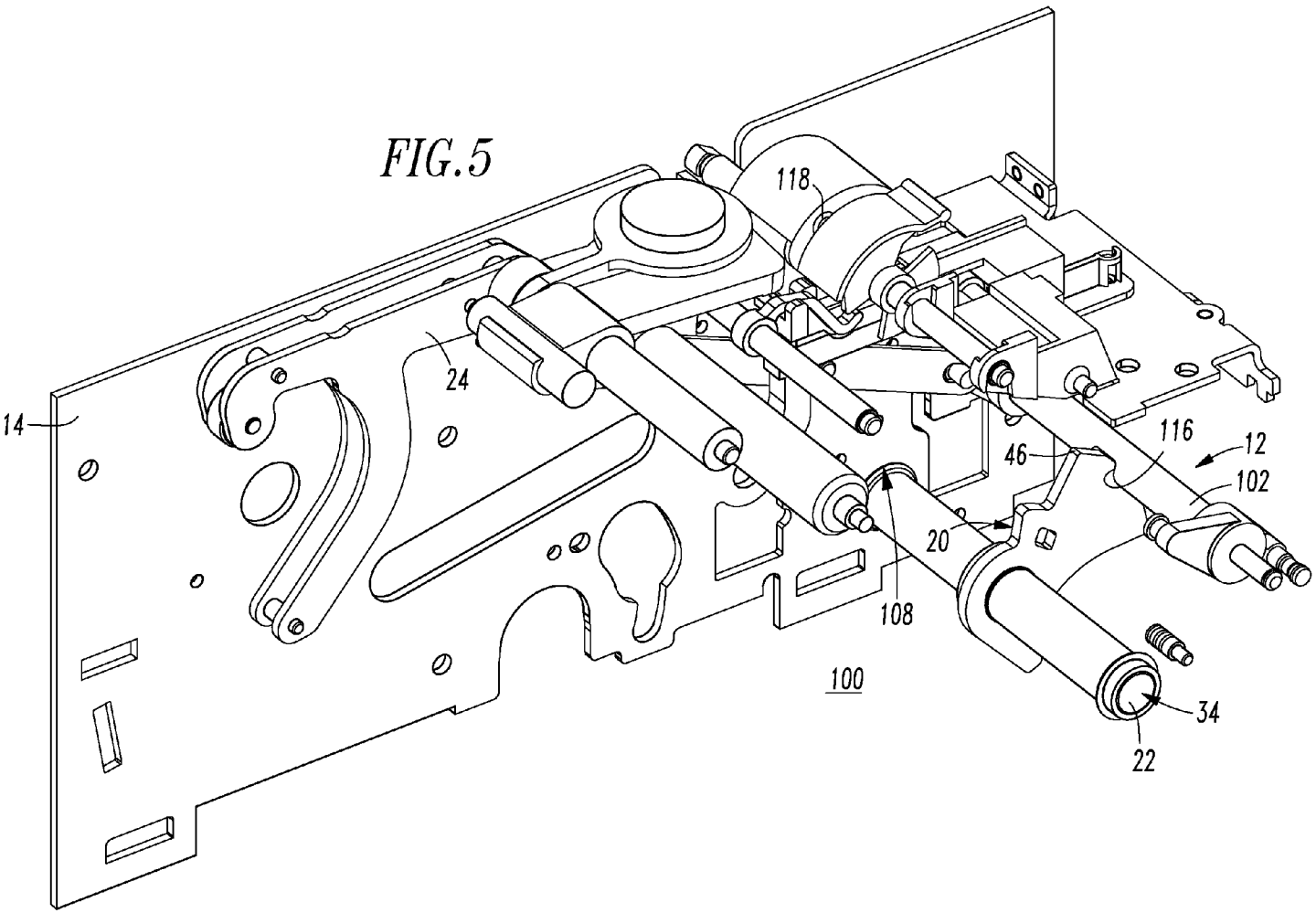
FIG. 5 is an isometric view of the status indicating assembly of FIG. 4, shown in the position corresponding to the circuit breaker being discharged and open.

Referring to FIG. 4, a status indicating assembly 100 is for an electrical switching apparatus such as, for example and without limitation, a circuit breaker 104 (partially shown in simplified form). The circuit breaker 104 includes a housing 105 (shown in phantom line drawing), separable contacts 106 (shown in simplified form) enclosed by the housing 105, and an operating mechanism 108 (shown in simplified form) for opening and closing the separable contacts 106. The operating mechanism 108 includes a stored energy mechanism, which in this example includes a closing spring 110 (partially shown in phantom line drawing). The operating mechanism 108 also includes an opening latch or trip latch 112, which is pivotable between a latched position (as shown), and an unlatched position (FIG. 5). The stored energy mechanism (only the closing spring 110 is shown) applies force to a toggle knee 118 and closes the circuit breaker 104. The separable contacts 106 can remain closed and the stored energy mechanism can be recharged while the circuit breaker 104 remains closed. The circuit breaker separable contacts 106 are closed and the opening latch 112 is latched (FIG. 4). When the opening latch 112 is rotated to the open position (FIG. 5), the separable contacts 106 then break connection.

In the example shown and described herein, the circuit breaker housing 105 further includes a pair of opposing side plates (only one side plate 114 is shown), and the status indicating assembly 100 is substantially disposed between the side plates. The opening latch or trip latch 112 includes the latch assembly 34 and the trip D-shaft 102. The latch assembly 34 is pivotally coupled to the side plates 14 (only one side plate 14 is shown) and is structured to pivot, or rock, between the latched position (FIG. 4) and the unlatched position (FIG. 5). In the latched position, the latch edge 40 engages the outer diameter of the trip D-shaft 102 and is held in place thereby. The trip D-shaft 102 is structured to rotate (clockwise with respect to FIG. 4) in response to a user input (e.g., actuation of a solenoid (not shown)). When the trip D-shaft 102 rotates, the latch edge 40 passes over the trip D-shaft 102 and enters the trip D-shaft opening 116, thereby allowing the latch assembly 34 to move into the unlatched position (FIG. 5).

The disclosed concept employs a low cost, multipart, purely mechanically joined latch assembly 34. As a result, optimum materials can be employed for the main latch components, which are the latch plate 20 and the latch shaft 22. Hence, a suitably high hardness latch assembly 34 is provided without compromising the hardness during a joining operation as is the case with a prior brazed latch assembly. The joining operation is a swaging operation that locates the latch plate 20 on the latch shaft 22 and locks these main latch components together by only a mechanical force. The cylindrical swaging or pressing tool 30 (FIG. 6) includes a central longitudinal opening 42 for receiving the shaft member 32 and a swaging surface 44 for swaging the sacrificial section 28.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A latch assembly comprising:
- a latch plate having an opening therethrough; and
- a latch shaft comprising a shaft member and a positioning shoulder disposed on said shaft member, said positioning shoulder having a seating surface thereon,
- wherein said latch shaft, the shaft member, the positioning shoulder and the seating surface are a single unitary piece of material,
- wherein said shaft member passes through the opening of said latch plate,
- wherein said latch plate engages the positioning shoulder of said shaft member, and
- wherein the seating surface of said shaft member is swaged to retain said latch plate to said shaft member.

2. The latch assembly of claim 1 wherein said shaft member retains said latch plate by only a mechanical force.

3. The latch assembly of claim 1 wherein said latch plate is made of a material selected from the group consisting of 1070 spring steel and 1095 spring steel; and
wherein said latch shaft is made of 1045 steel.

4. The latch assembly of claim 1 wherein said latch assembly is heat treated to provide a hardness of said latch plate in the range of HRC 50 to HRC 55.

5. The latch assembly of claim 4 wherein said latch assembly is plated per ASTM B733.

6. The latch assembly of claim 1 wherein a portion of the seating surface of said shaft member forms a bead of material around the opening of said latch plate to mechanically retain said latch plate to said shaft member.

7. The latch assembly of claim 1 wherein said single unitary piece of material is concentric and has a central longitudinal axis; and wherein the positioning shoulder is perpendicular to said central longitudinal axis.

8. The latch assembly of claim 1 wherein said latch plate is a planar member having a latch edge.

9. The latch assembly of claim 1 wherein the seating surface of said shaft member is structured to be swaged by a swaging or pressing tool.

10. The latch assembly of claim 1 wherein said seating surface comprises a sacrificial seating surface that is mechanical deformed when said sacrificial seating surface is swaged to retain said latch plate to said shaft member.

11. An electrical switching apparatus comprising:
- separable contacts;
- an operating mechanism structured to open and close said separable contacts; and
- a latch comprising:
  - a D-shaft,
  - a latch plate having an opening therethrough, said latch plate having a portion structured to engage said D-shaft, and
  - a latch shaft comprising a shaft member and a positioning shoulder disposed on said shaft member, said positioning shoulder having a seating surface thereon,
  - wherein said latch shaft, the shaft member, the positioning shoulder and the seating surface are a single unitary piece of material,
  - wherein said shaft member passes through the opening of said latch plate,
  - wherein said latch plate engages the positioning shoulder of said shaft member, and
  - wherein the seating surface of said shaft member is swaged to retain said latch plate to said shaft member.

12. The electrical switching apparatus of claim 11 wherein said shaft member retains said latch plate by only a mechanical force.

13. The electrical switching apparatus of claim 11 wherein said latch plate is made of a material selected from the group consisting of 1070 spring steel and 1095 spring steel; and wherein said latch shaft is made of 1045 steel.

14. The electrical switching apparatus of claim 11 wherein after being swaged said latch plate and said latch shaft are heat treated to provide a hardness of said latch plate in the range of HRC 50 to HRC 55.

15. The electrical switching apparatus of claim 11 wherein after being heat treated said latch plate and said latch shaft are plated per ASTM B733.

16. The electrical switching apparatus of claim 11 wherein a portion of the seating surface of said shaft member forms a bead of material around the opening of said latch plate to mechanically retain said latch plate to said shaft member.

17. The electrical switching apparatus of claim 11 wherein said single unitary piece of material is concentric and has a central longitudinal axis; and wherein the positioning shoulder is perpendicular to said central longitudinal axis.

18. The electrical switching apparatus of claim 11 wherein said latch plate is a planar member having a latch edge engaging said D-shaft; and wherein the portion of said latch plate is the latch edge of the planar member.

19. The electrical switching apparatus of claim 11 wherein the seating surface of said shaft member is structured to be swaged by a swaging or pressing tool.

20. The electrical switching apparatus of claim 11 wherein said seating surface comprises a sacrificial seating surface that is mechanical deformed when said sacrificial seating surface is swaged to retain said latch plate to said shaft member.

21. A latch comprising:

a D-shaft;

a latch plate having an opening therethrough, said latch plate having a portion structured to engage said D-shaft; and a latch shaft comprising a shaft member and a positioning shoulder disposed on said shaft member, said positioning shoulder having a seating surface thereon, wherein said latch shaft, the shaft member, the positioning shoulder and the seating surface are a single unitary piece of material, wherein said shaft member passes through the opening of said latch plate, wherein said latch plate engages the positioning shoulder of said shaft member, and wherein the seating surface of said shaft member is swaged to retain said latch plate to said shaft member.

22. The latch assembly of claim 1 wherein the seating surface of the positioning shoulder includes a grooved surface engaging the latch plate at the opening thereof.

23. The electrical switching apparatus of claim 11 wherein the seating surface of the positioning shoulder includes a grooved surface engaging the latch plate at the opening thereof.

24. The latch of claim 21 wherein the seating surface of the positioning shoulder includes a grooved surface engaging the latch plate at the opening thereof.

* * * * *